US011424578B2

(12) United States Patent
Droesbeke et al.

(10) Patent No.: US 11,424,578 B2
(45) Date of Patent: Aug. 23, 2022

(54) ELECTRICAL CONNECTOR

(71) Applicant: APTIV TECHNOLOGIES LIMITED, St. Michael (BB)

(72) Inventors: Gert Droesbeke, Erkrath (DE); Jannik Renfordt, Solingen (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 169 days.

(21) Appl. No.: 16/797,560

(22) Filed: Feb. 21, 2020

(65) Prior Publication Data

US 2020/0280149 A1 Sep. 3, 2020

(30) Foreign Application Priority Data

Feb. 28, 2019 (EP) ..... 19160076

(51) Int. Cl.

| | |
|---|---|
| ***H01R 13/6477*** | (2011.01) |
| ***H01R 13/405*** | (2006.01) |
| ***H01R 13/6588*** | (2011.01) |
| ***H01R 43/24*** | (2006.01) |

(52) U.S. Cl.

CPC ..... *H01R 13/6477* (2013.01); *H01R 13/405* (2013.01); *H01R 13/6588* (2013.01); *H01R 43/24* (2013.01)

(58) Field of Classification Search

CPC ..... H01R 13/6477; H01R 13/405; H01R 13/6588; H01R 13/6585; H01R 43/24; H01R 13/53; H01R 13/5227

USPC ..... 439/194, 198

See application file for complete search history.

(56) References Cited

U.S. PATENT DOCUMENTS

| | | | | |
|---|---|---|---|---|
| 7,789,676 | B2 * | 9/2010 | Morgan | H01R 13/6587 439/79 |
| 7,952,035 | B2 * | 5/2011 | Falk | H01R 13/5216 174/667 |
| 8,911,266 | B2 * | 12/2014 | Kawate | H01R 13/6596 439/700 |
| 10,594,039 | B2 * | 3/2020 | Henry | H01P 5/087 |
| 2003/0203677 | A1 | 10/2003 | Spiegel et al. | |
| 2010/0048058 | A1 * | 2/2010 | Morgan | H01R 13/6587 439/607.05 |

FOREIGN PATENT DOCUMENTS

| | | | |
|---|---|---|---|
| CN | 102368579 | A | 3/2012 |
| CN | 107959199 | A | 4/2018 |
| CN | 108767508 | A | 11/2018 |
| EP | 3999611 | A1 | 5/2000 |

OTHER PUBLICATIONS

Chinese Office Action for Chinese Application No. 202010119331.2 dated Mar. 16, 2021.

* cited by examiner

*Primary Examiner* — Renee S Luebke
*Assistant Examiner* — Paul D Baillargeon
(74) *Attorney, Agent, or Firm* — Carlson, Gaskey & Olds, P.C.

(57) ABSTRACT

An electrical connector for high frequency data signal transmission includes a housing, at least one tunnel extending through the housing and at least one electrical lead extending through the at least one tunnel. At least a portion of the electrical lead in the tunnel is embedded in a surrounding material having a relative permittivity which is less than 2.

18 Claims, 7 Drawing Sheets

ELECTRICAL CONNECTOR

CROSS-REFERENCE TO RELATED APPLICATIONS

This application claims priority to European Patent Application No. EP 19160076.6, filed on Feb. 28, 2019.

The present invention relates to an electrical connector for high frequency data signal transmission comprising a housing, at least one tunnel extending through the housing and at least one electrical lead extending through the tunnel.

An electrical connector of this kind, which may also be called a pin header is well known in the art and is typically used for the transmission of signals at high data rates, for example data rates between 1 and 100 GHz. The signals are transmitted via the at least one electrical lead which is preferably made of a conductive material such as a metal material.

For high data rate applications sufficient shielding of the transmitted signals against external electromagnetic fields is a major issue to avoid or at least minimize any disturbance of the transmitted signal by the external electromagnetic fields. In particular, an external electromagnetic field might alter a signal transmitted through an unshielded electrical lead, which ultimately leads to an impaired signal-to-noise ratio and/or unwanted jittering of the signal. Moreover, shielding of the transmitted signals is of special interest to prevent or at least reduce any possible crosstalk, i.e. an unwanted signal exchange between adjacent electrical leads of the same electrical connector or between electrical leads of adjacent or neighboring electrical connectors.

For these reasons, at least a portion of the housing of the electrical connector is made of a conductive material, with the housing acting as a Faraday cage. Moreover, in order to keep the electrical lead in place and at a predefined distance to the conductive housing, the electrical lead is embedded in a solid state insulating material, such as an insulating plastic material, which is arranged between the electrical lead and an inner wall of the tunnel facing the electrical lead.

In order to shield the transmitted signals against unwanted external electromagnetic fields and at the same time to keep production costs low, known prior art electrical connectors comprise a housing made of a conductive plastic material. However, the shielding quality of conductive plastic materials is rather poor, so that a housing made of a conductive plastic material often requires additional metal parts to enhance the shielding properties, thereby increasing production costs.

In comparison to conductive plastic materials, metal materials comprise better shielding properties but processing is more elaborate if the housing is created by stamping and subsequently bending or deep drawing of a sheet metal material. In addition, housings made of sheet metal allow only for a limited freedom of design.

Furthermore, a housing made from a bent or deep drawn sheet metal may comprise unshielded apertures between corners or edges of the bent or deep drawn sheet metal, with the apertures being prone to the ingress of external electromagnetic fields into the housing or to the leakage of the transmitted signal out of the housing. By way of example, in order to achieve good shielding for 12 GHz data rate applications, the size of an aperture needs to be less than 0.5 mm.

Moreover, if the electrical lead is embedded in a solid state insulating material, the solid state material might ooze out through the apertures. As this leakage of the solid state insulating material cannot be controlled or can only be controlled to a certain extent, signal transmission properties of an electrical connector are less reproducible.

Therefore, in order to keep the apertures as small as possible, sophisticated bending or deep drawing techniques are required leading to a tremendous increase in production costs. However, such sophisticated bending or deep drawing techniques are waived in favor of production costs and at the expense of sufficient shielding and signal integrity, i.e. good signal-to-noise ratio and minimum jittering of the transmitted signals.

Furthermore, regarding prior art electrical connectors, it is rather cumbersome to reproducibly arrange the components of the electrical connector, i.e. basically the at least one electrical lead, the tunnel, the insulating material and the housing such that each section of the electrical connector comprises an optimum impedance matching or that an impedance mismatch is at least kept at minimum.

SUMMARY

Embodiments of the invention provide an electrical connector having improved signal integrity, which transmits signals with optimum signal-to-noise ratio and minimum jittering. The electrical connector may have good shielding against external electromagnetic fields and reproducible impedance matching.

The electrical connector for high frequency data signal transmission according to an example embodiment comprises a housing, at least one tunnel extending through the housing and at least one electrical lead extending through the at least one tunnel. At least a portion of the electrical lead in the at least one tunnel is embedded in a surrounding material having a relative permittivity which is less than 2.

Surprisingly it has been shown that the propagation time of a signal being transmitted via the at least one electrical connector embedded in a surrounding material is affected by the relative permittivity of the surrounding material. In particular, the propagation time of the transmitted signal is reduced if the relative permittivity of the surrounding material is lowered. In other words although the physical length of the at least one electrical lead stays the same, the signal path length of the signal transmitted through the at least one electrical lead will become shorter if the at least one electrical lead is embedded in a surrounding material having a lower relative permittivity.

A shorter signal path length has the advantage that a signal transmitted via the electrical lead will be less affected by any unavoidable impedance mismatch present in an electrical connector, since the impedance mismatch cannot or at least cannot significantly affect the transmitted signal during the short propagation time in which the signal is transmitted through the electrical connector. By way of example, the signal will not be affected by the electrical connector if the propagation time is less than about one tenth of the rise time after degradation, wherein the rise time after degradation approximately equals to the double of the input rise time. The input rise time is the time which the signal essentially needs to build up to its maximum value.

Hence, as the transmitted signal will be not affected or at least less affected by the unavoidable impedance mismatch, the signal will be not or at least less disturbed so that the signal integrity is enhanced and the signal-to-noise ratio is enhanced and jittering of the transmitted signals is reduced. Furthermore, as the signal will be not or only minimally affected by the impedance mismatch, the return loss which is a key performance indicator of a high frequency data rate electrical connector is improved.

Thus, the invention is based on the general idea that the signal integrity of a transmitted signal is enhanced if at least one electrical lead extending through a tunnel which extends through a housing of an electrical connector is embedded in a surrounding material inside the tunnel, with the surrounding material having a relative permittivity which is as low as possible, at least however less than 2.

Further benefits and advantageous embodiments of the invention become apparent from the dependent claims, from the description and from the accompanying drawings.

Preferably, the surrounding material directly abuts the at least one electrical lead. Moreover, the tunnel can be entirely filled with the surrounding material, i.e. the surrounding material is preferably arranged between the at least one electrical lead and an inner wall of the tunnel facing the electrical lead.

As the signal path length in the electrical lead can be reduced if the relative permittivity of the surrounding material is lowered, the relative permittivity of the surrounding material should be less than 1.5, preferably less than 1.1 and more preferably at least approximately 1. The signal path length will be shortest if the relative permittivity of the surrounding material ideally equals 1.

The surrounding material will have a low relative permittivity if the surrounding material advantageously is a fluid, preferably a gas and more preferably air. Air is particularly preferred as a surrounding material, as the relative permittivity of air is nearly 1. In this context, vacuum having per definition a relative permittivity of exactly 1 is also considered to be a surrounding material according to the invention. Furthermore, it should be mentioned that the surrounding material may also be a foam, wherein the relative permittivity of the foam is an average value of the foaming material and the gas enclosed in cavities of the foam.

Furthermore, in contrast to an insulating solid state surrounding material the impedance for each section of the tunnel can be reproducibly and more easily adjusted if the surrounding material is a fluid and in particular a gas such as air. By way of example, the impedance in each section of the tunnel should be matched to 100Ω(100 Ω=100 Ohm=100 Volt/Ampere).

In order to sufficiently shield the electrical lead, at least an inner surface of a tunnel wall facing the at least one electrical lead may be electrically conductive. In this case the rest of the housing may be formed of an insulating or low conductive material. Furthermore, if the housing is formed of an insulating or low conductive material, the inner wall of the tunnel facing the at least one electrical lead may be covered with a conductive layer. The housing may also be a metalized plastic part.

However, the housing may also be made of a conductive material, preferably a metal material, to sufficiently shield the electrical lead in the tunnel. It should be mentioned that the electrical connector may comprise further parts that enhance the shielding. For example, a portion of the housing may be covered by a hood made of a conductive material.

The housing may be an integral part. However, in order to facilitate the assembly of the electrical connector, the housing may comprise a base part defining a first portion of the tunnel and a cover part defining a second portion of the tunnel such that the base part and the cover part together form the tunnel. Not only is the assembly of the electrical connector facilitated if the housing comprises a base part and a cover part, but also the at least one electrical lead can be better arranged with regard to the tunnel wall, allowing for an optimum impedance match.

In particular, the base part and the cover part may be connected to each other in the direction of the tunnel extending through the housing, i.e. along the length of the tunnel. Additionally or alternatively, the housing may also comprise at least two parts that are connected to each other in a direction traverse to the tunnel extending through the housing, i.e. traverse to the length of the tunnel, wherein each of the at least two parts defines a portion of the tunnel.

The housing may be die casted, 3D printed, injection molded or a machined part, whether it is an integral part or made of a base part and a cover part. It is to be understood, that if the housing comprises a base part and a cover part, at least one of the base part or cover part may be die casted, 3D printed, injection molded or a machined part. Such kind of manufacturing of the housing or its components allows for a greater freedom of design of the electrical connector. In particular, an optimum impedance match for each section of the tunnel can be tailored.

Principally, the cover part may be connected to the base part by any kind of connection means, such as for example snap-on means. However, better shielding with fewer apertures is achieved if the cover part is riveted and/or welded, in particular cold welded, to the base part. It should be understood that the base part could be riveted and/or welded, in particular cold welded, to the cover part.

In order to further enhance the shielding properties of the housing, the cover part comprises an inner ridge forming a portion of a wall of the tunnel and the base part comprises an outer ridge which is arranged adjacent to the inner ridge such that the inner ridge and the outer ridge define a gap, preferably a capillary, between the inner ridge and the outer ridge. In other words, the outer ridge of the base part receives the inner ridge of the cover part. It should be mentioned that the cover part could also be designed in such manner that the cover part comprises an outer ridge that receives an inner ridge of the base part.

Shielding properties of the housing are further enhanced if the gap is filled with a solder material, preferably tin or a tin containing alloy. In particular, the solder material may be applied to at least one of the base or cover parts prior to the connection of the base and cover parts. The solder material may then melt during the connection process or may be molten after the connection of the base part and the cover part. The solder material may also be applied to the base part and/or cover part after they have been connected.

In order to provide an electrical connector having more than one tunnel, the housing may comprise at least one intermediate part arranged between the base part and the cover part such that at least a first tunnel is defined by the base part and the intermediate part and at least a second tunnel is defined by the cover part and the intermediate part.

The electrical connector may comprise at least one supporting element supporting the at least one electrical lead at a distance from a tunnel wall facing the at least one electrical lead, with the supporting element being inserted into the tunnel. Furthermore, if the electrical connector comprises more than one electrical lead, the supporting element may also serve for keeping the multiple electrical leads at a predefined distance. Furthermore, the supporting element may be over-molded onto the at least one electrical lead, thereby firmly securing the electrical lead.

In order to avoid any electrical contact between the tunnel wall and/or adjacent electrical leads, the material of the supporting element may be an insulating solid state material, preferably an insulating plastic material. In this context, solid state materials also comprise gelatinous materials.

The supporting element should be made of a material having a relative permittivity being as low as possible for the same reason as the relative permittivity of the surrounding material should be as low as possible. However, as the surrounding material preferably is a material having a relative permittivity of nearly 1, the insulating solid state material of the supporting element most probably will have a higher relative permittivity. Therefore, according to a preferred design, the relative permittivity of the surrounding material is less than the relative permittivity of the material of the supporting element. However, if an insulating solid state material exists that has a relative permittivity of less than 2, preferably less than 1.5 and more preferably approximately 1, such kind of material is preferred.

Nevertheless, good results as to signal integrity and impedance matching have been achieved with the material of the supporting element being preferably a liquid crystal polymer having a relative permittivity of at least approximately 3.

According to a preferred design, two supporting elements may close-off the tunnel at opposite ends and the at least one electrical lead extends through each of the two supporting elements. By closing-off the tunnel, the supporting elements further act as a barrier against external influences which may be for example external electromagnetic fields and/or humidity and/or other gases. In this context it should be mentioned, that a change of the composition of the surrounding material will also alter its relative permittivity thereby changing the impedance matching and ultimately the transmitted signals. Therefore, it is preferred if the supporting elements close-off the tunnel. Good closing behaviour may be achieved if each of the supporting element is over-molded onto the at least one electrical lead, thereby tightly sealing the tunnel where the at least one electrical lead passes through a supporting element.

A further benefit of using a surrounding material having a relative permittivity being as low as possible is that for the same impedance, a portion of the electrical lead surrounded by the surrounding material can have a larger cross-sectional area than a portion of the electrical lead surrounded by the supporting element. In other words, for the same impedance, the cross-sectional area of the electrical lead can be larger if the electrical lead is surrounded by a surrounding material having a lower relative permittivity than by a surrounding material having a higher relative permittivity.

A larger cross-sectional area of the electrical lead is beneficial as to signal integrity at least for the following reasons.

Firstly, in high frequency data rate signal transmission the electrical current is mainly conducted near a radially outer surface of the electrical lead, which is also known as skin effect, as the current is conducted at the "skin" of the electrical lead. If the cross-sectional area of the electrical lead becomes larger, more current may be conducted on its outer surface, thereby leading to a better signal-to-noise ratio.

Secondly, a larger cross-sectional area of the electrical lead is advantageous with regard to manufacturing tolerances, as a larger cross-sectional area of the electrical lead is less prone to fluctuations in the cross-sectional area size compared to an electrical lead having a smaller cross-sectional area. Therefore, the reproducibility of manufactured electrical leads can be enhanced.

The electrical lead can be easily manufactured if at least a portion of the electrical lead is a flat strip configured to be arranged in the tunnel. The flat strip may comprise two opposing long sides and two opposing short sides. Furthermore, the flat strip may comprise at least one round edge. Preferably, the round edge forms a short side of the flat strip. If the flat strip comprises at least one round edge, cornering effects due to which a main portion of the electrical current is only conducted in the corners of a rectangular electrical lead are avoided or at least reduced. It is to be mentioned that the flat strip may also comprise at least one sharp edge or at least one angled edge, in particular a rectangular edge.

Although the electrical connector has been described above as having only one tunnel, the electrical connector may comprise more than one tunnel, with each tunnel being configured to receive at least one electrical lead, i.e. one electrical lead or two or more electrical leads extending through the tunnel.

Embodiments of the invention include a method of manufacturing an electrical connector as described above.

BRIEF DESCRIPTION OF THE DRAWINGS

At least one example embodiment will be described in the following purely by way of example with reference to possible designs and to the enclosed drawings in which:

FIGS. 1 to 3*d* relate to a first design of an electrical connector for high frequency data signal transmission. FIG. 4 shows an electrical connector according to a second design. FIGS. 5 to 7*b* are directed to a third design of an electrical contact element.

DETAILED DESCRIPTION

Figure 1:
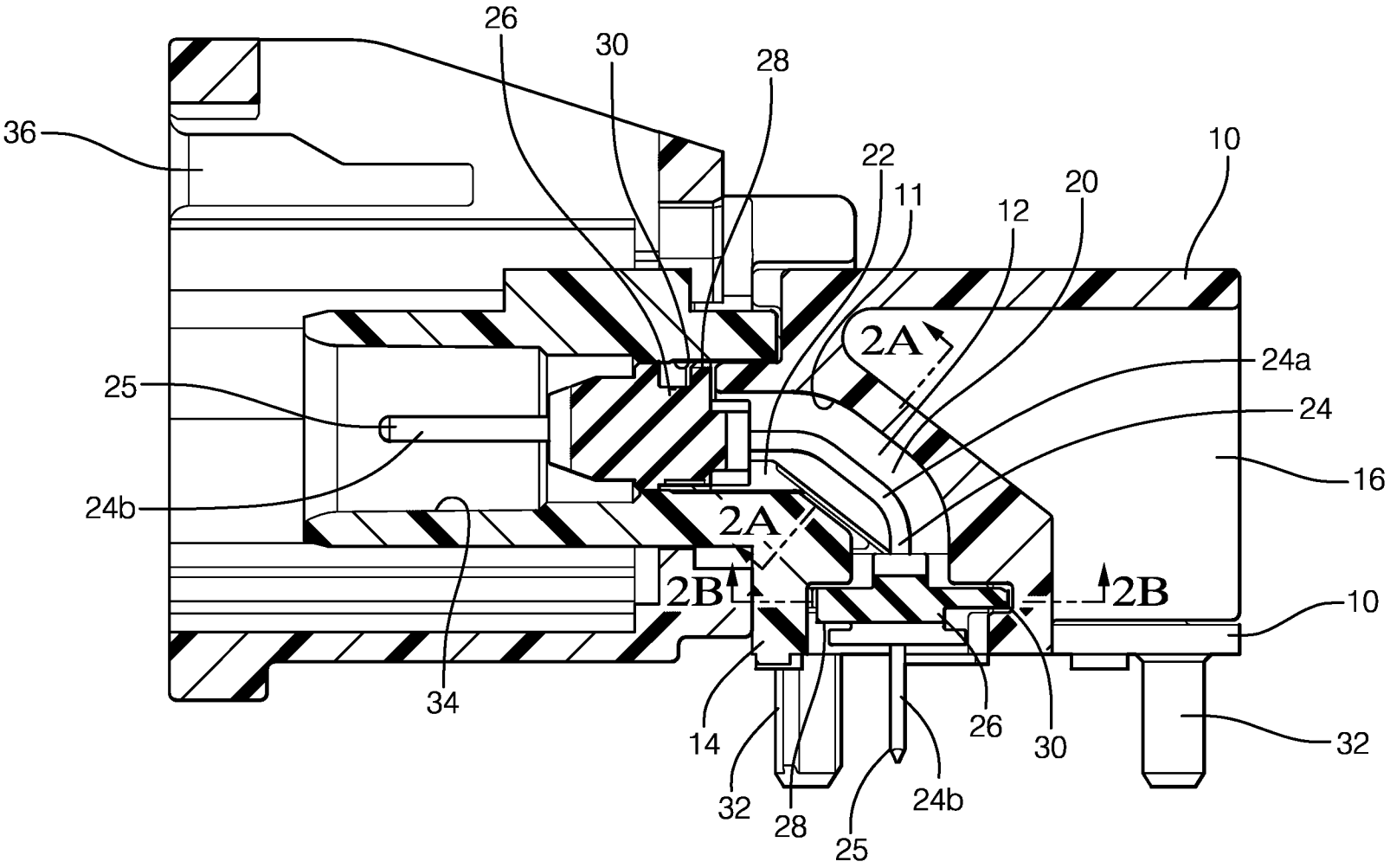
FIG. 1 shows a longitudinal sectional view of an electrical connector according to a first design.

FIG. 1 shows a longitudinal sectional view of an electrical connector for high frequency data signal transmission. The electrical connector comprises a housing 10 with a tunnel 12 extending therethrough. Furthermore, the housing 10 comprises a base part 14 defining a first portion of the tunnel 12 and a cover part 16 defining a second portion of the tunnel 12. Hence, in an assembled state of the housing 10 the base part 14 and the cover part 16 together form the tunnel 12.

In order to provide good shielding properties of the housing 10, the cover part 16 is tightly riveted to the base part 14, as will be described in detail below. Furthermore, although not shown in the drawings for the purpose of better illustration, the cover part 16 is additionally cold welded to the base part 14 by means of a solder material, thereby further enhancing the shielding properties of the housing 10. The solder material may be tin or a tin containing alloy.

Figure 2A:
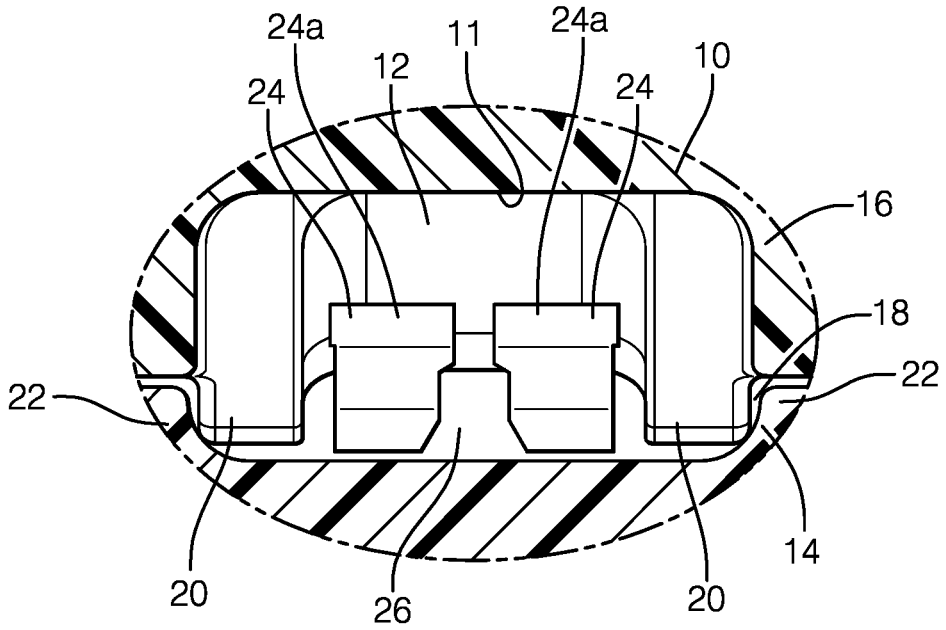
FIG. 2*a* shows a cross sectional view along line A-A of FIG. 1.
Figure 2B:
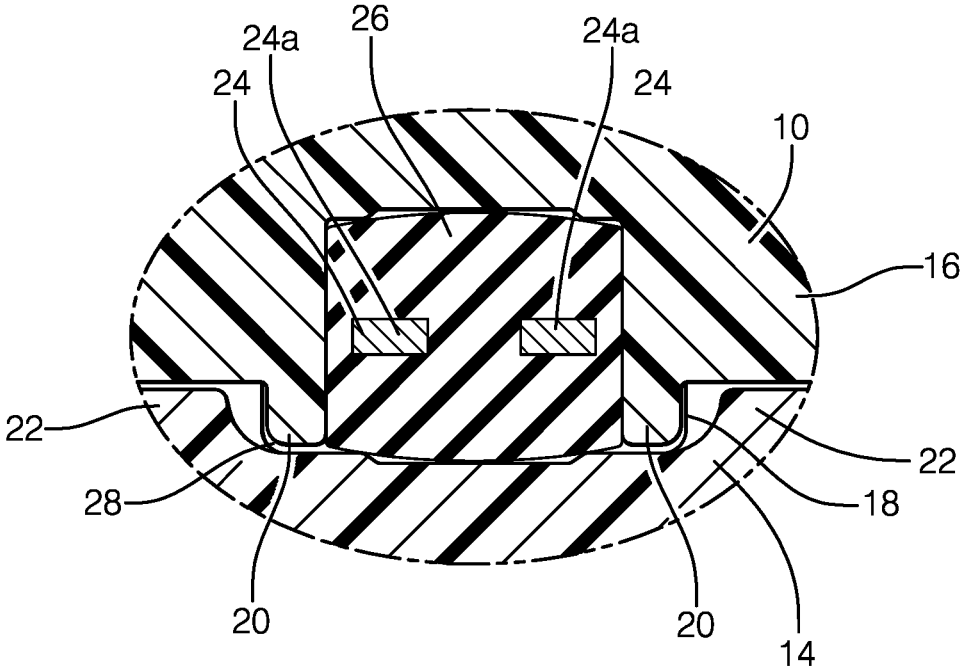
FIG. 2*b* shows a cross sectional view along line B-B of FIG. 1.

The solder material is intended to fill out a gap 18 which is formed between an inner ridge 20 of the cover part 16 and an outer ridge 22 of the base part 14, wherein the outer ridge 22 of the base part 14 is arranged adjacent to the inner ridge 20 of the cover part 16 (FIGS. 2*a* and 2*b*). The gap 18 is preferably formed as a capillary which allows the solder material to entirely fill out the gap 19 to enhance the shielding properties of the housing 10.

As can be seen in FIGS. 2*a* and 2*b* the inner ridge 20 of the cover part 16 forms a portion of an inner wall 11 of the tunnel 12. Furthermore, at least the surface of the wall 11 of the tunnel 12 may be electrically conductive. However, in the present design, not only the surface of the wall 11 of the tunnel 12 is electrically conductive but the entire housing 10, i.e. the base part 14 and the cover part 16 are made of a conductive material, such as a metal material.

Furthermore, at least one electrical lead 24 made of an electrically conductive material extends through the tunnel 12. The electrical connector according to the present design comprises two electrical leads 24 (FIGS. 2*a*, 2*b*, 3*a* and 3*b*). It should be noted that the electrical lead may comprise less or more than two electrical leads 24. Each electrical lead 24 comprises a flat strip section 24*a* (FIGS. 1, 2*a*, 2*b* and 3*a*) and a round section 24*b* (FIGS. 1 and 3*a*), with the round section 24*b* serving as connection portions 25 of the electrical connector. Although FIGS. 2*a* and 2*b* show two electrical leads 24 comprising rectangular flat strip sections 24*a*, the edges of the flat strip sections 24*a* may be rounded to minimize cornering effects.

The electrical leads 24 are separated from each other and from the wall 11 of the tunnel 12 by means of a supporting element 26 made of made of an insulating solid state material. The insulating solid state material may be an insulating plastic material such as a liquid crystal polymer whose relative permittivity is 3.

In particular, the electrical leads 24 are supported by two supporting elements 26, which are inserted into the tunnel 12 to support the electrical leads 24 at a distance from the wall 11 of the tunnel facing the electrical leads 24.

As can be seen best in FIG. 1 each supporting element 26 comprises a protrusion 28 that is received in a pocket 30 formed in the tunnel 12 by the base part 14 and the cover part 16.

In the tunnel 12 the electrical leads 24 are embedded in a surrounding material having a relative permittivity of less than 2. In the present design, the relative permittivity of the surrounding material is even lower than 2 as air is used as a surrounding material having a relative permittivity of nearly 1. It is to be understood that the surrounding material may be a material other than air, for example a fluid and preferably a gas, with the surrounding material having a relative permittivity of less than 1.5, preferably less than 1.1. Ideally the surrounding material should have a relative permittivity of 1.

Since the relative permittivity of air used as surrounding material is nearly 1 and therefore rather low, the relative permittivity of the supporting elements 26 typically will be higher. Therefore, the relative permittivity of the surrounding material is less than the relative permittivity of the material of the supporting elements 26. As a consequence, for the same impedance, the cross-sectional area of the electrical leads 24 can be larger if the electrical leads 24 are surrounded by the surrounding material having a lower relative permittivity instead of the supporting elements 26 having a higher relative permittivity. The larger cross-sectional area of the electrical leads 24 is beneficial for high data transmission rates, as the current is mainly conducted at a radially outer surface of each of the electrical leads 24 as the frequency increases. Furthermore, a larger cross-sectional area of the electrical leads 24 is advantageous with regard to manufacturing tolerances.

The electrical connector comprises four mounting pins 32 for attaching the electrical connector to a printed circuit board (PCB). Furthermore, on the other end, the housing 10 of the electrical connector, more specifically the base part 14, comprises a connection recess 34 configured to receive a connector plug which is not shown in the drawings. The connection recess 34 is additionally shielded by a shielding cap 36. The shielding cap 36 may be made of a conductive metal material. However, in favour of cost efficiency and a more balanced center of gravity of the electrical connector, the shielding cap 36 is preferably made of a plastic material. The plastic material of the shielding cap 36 may be conductive, but sufficient shielding properties may be also achieved if the plastic material is not conductive.

It should be noted that although the connection recess 34 is arranged at right angle with regard to the mounting pins 32, the connection recess 34 may be arranged at other angles with regard to the mounting pins 32, for example at 45° or 180°.

In the following the assembly of the electrical connector will be described with regard to FIGS. 3*a* to 3*d*.

Figure 3A:
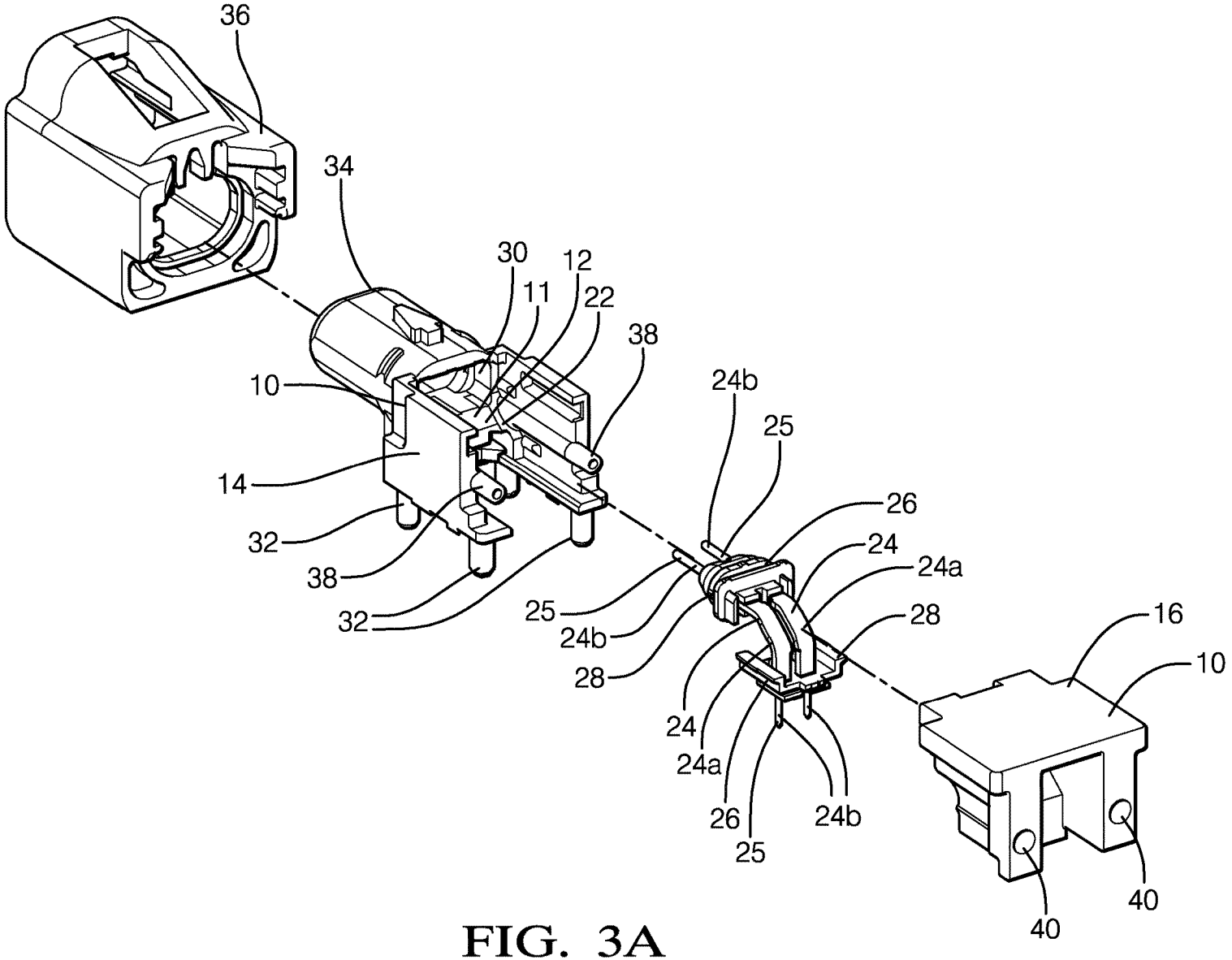
FIG. 3*a* shows a perspective view of the electrical connector of FIG. 1 in a first step of assembly.

Assembly of the electrical connector begins at FIG. 3*a* with providing the base part 14 and the cover part 16 of the housing 10. Furthermore, two electrical leads 24 are provided. Each of the electrical leads 24 is over-molded with a common supporting element 26 at a first section of each of the electrical leads 24 and a common supporting element 26 at a second section of each of the electrical leads 24. The first and second sections of each of the electrical leads 24 are separated from each other in a longitudinal direction of each electrical lead 24.

Figure 3B:
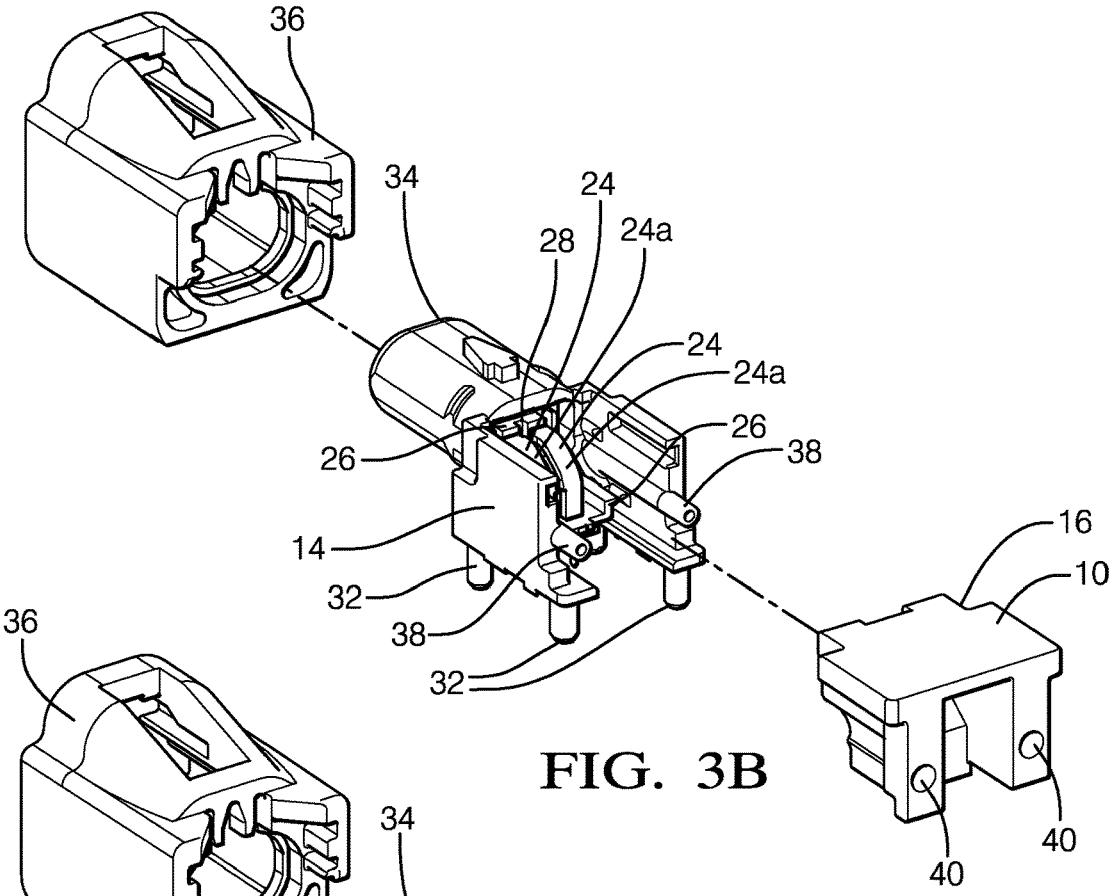
FIG. 3*b* shows a perspective view of the electrical connector of FIG. 1 in a second step of assembly.

As can be seen in FIG. 3*b*, the electrical leads 24 are arranged in the first portion of the tunnel defined by the base part 14. In particular, the protrusions 28 of the supporting elements 26 of the over-molded electrical leads 24 are placed in the associated portions of the pockets 30 defined by the base part 14 (cf. also FIG. 1).

Figure 3C:
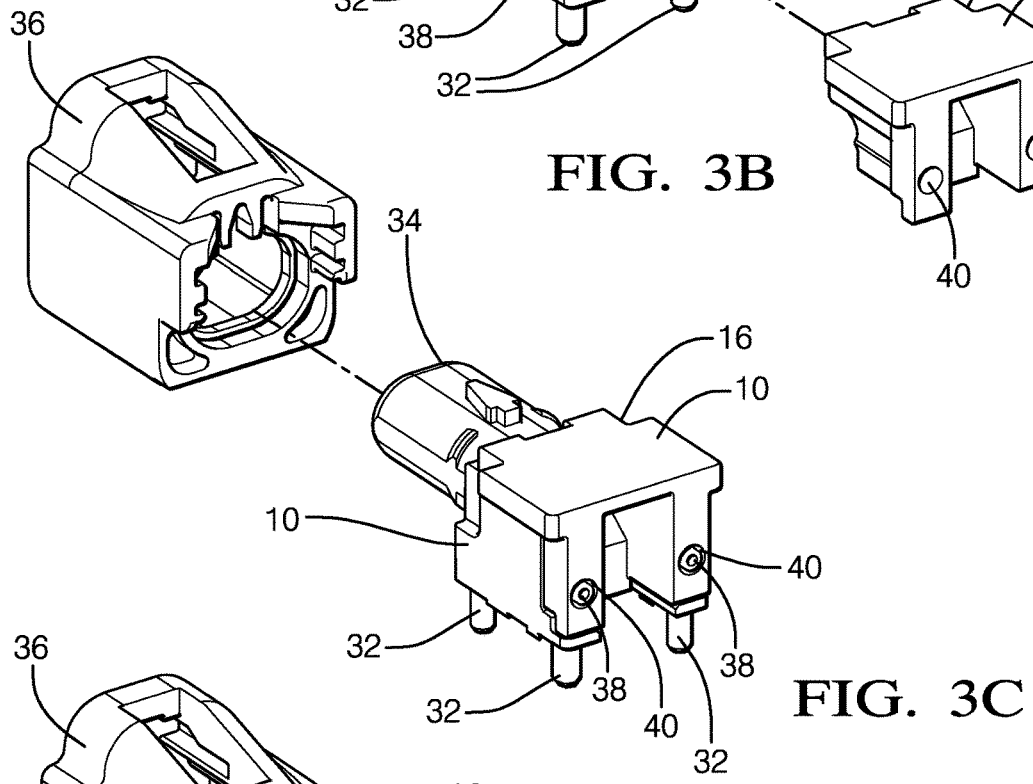
FIG. 3*c* shows a perspective view of the electrical connector of FIG. 1 in a third step of assembly.
Figure 3D:
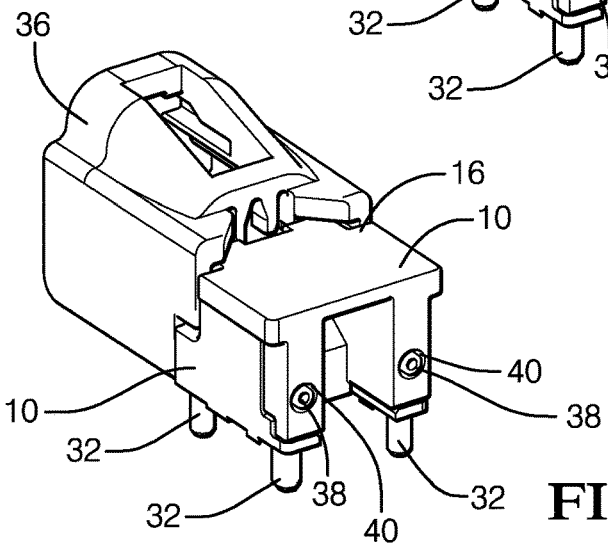
FIG. 3*d* shows a perspective view of the assembled electrical connector of FIG. 1.

In the next step shown in FIG. 3*c*, the cover part 16 is riveted onto the base part 14 of the housing 10. For this purpose, the base part 14 comprises two riveting mandrels 38, each of which is received in a corresponding riveting opening 40 of the cover part 16. It is to be understood that the base part 14 may comprise more or less than two riveting mandrels 38, i.e. the base part 14 may comprise one, two three, four, five or more riveting mandrels 38. Correspondingly, the cover part 16 may comprise more or less than two riveting openings 40, i.e. the cover part 16 may comprise one, two, three, four, five or more riveting openings 40. Furthermore, the base part 14 may comprise at least one riveting mandrel 38 and at least one riveting opening 40 and the cover part 16 may comprise at least one corresponding riveting opening 40 and at least one corresponding riveting mandrel 38. Such a configuration allows for an unambiguous assembly of the housing 10. It should also be mentioned that the base part 14 may only comprise at least one riveting opening 40 configured to receive at least one riveting mandrel 38 provided only on the cover part 16.

During riveting, the solder material arranged between the base part 14 and the cover part 16 may then flow into the gap 18 due to heating during the riveting process. Optionally the solder material may liquefied by a subsequent cold welding process. In the last step of the assembly, the shielding cap 36 is attached onto connection recess 34 and the electrical connector is ready for use.

Figure 4:
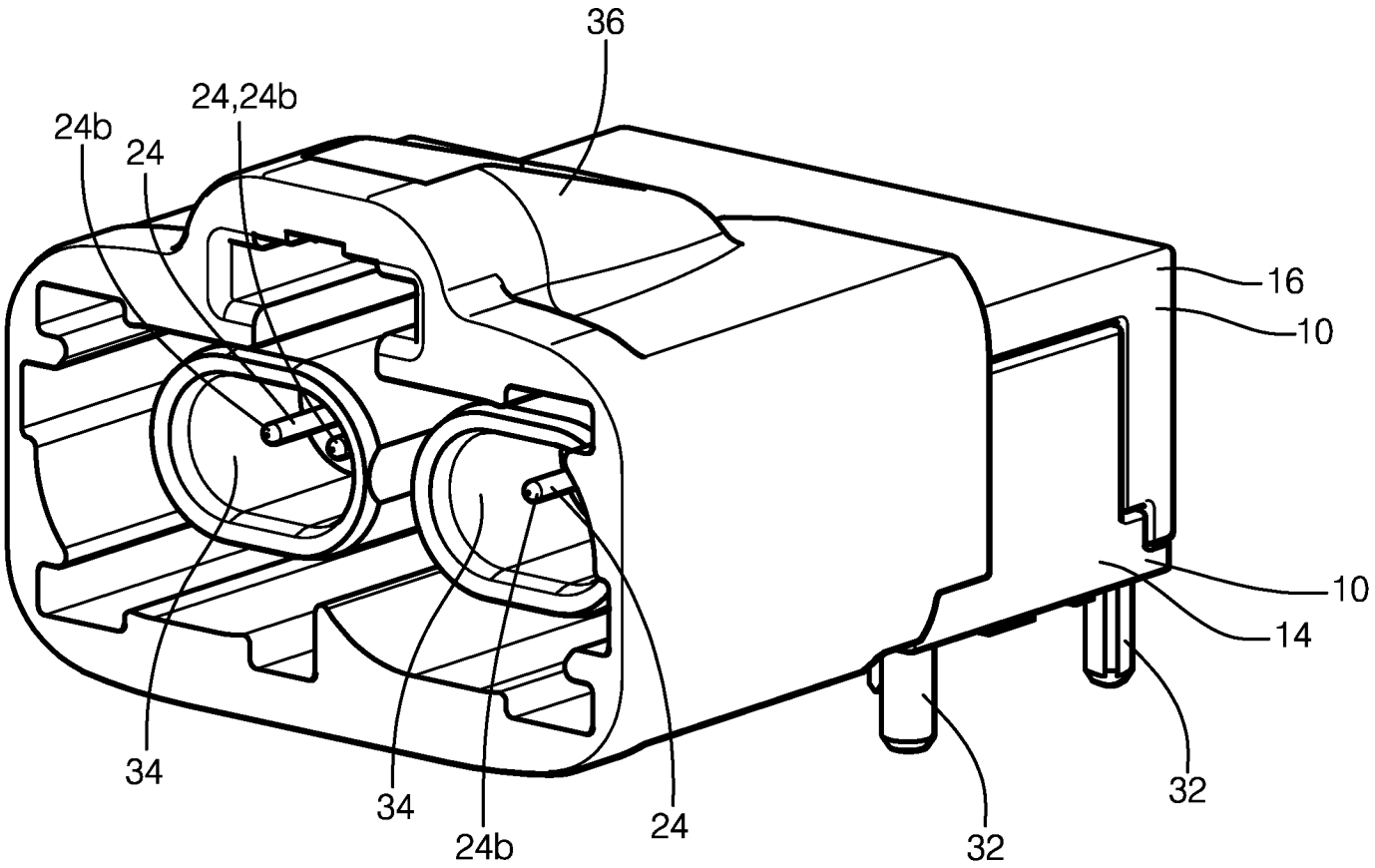
FIG. 4 shows a perspective view of an electrical connector according to a second design.
Figure 5:
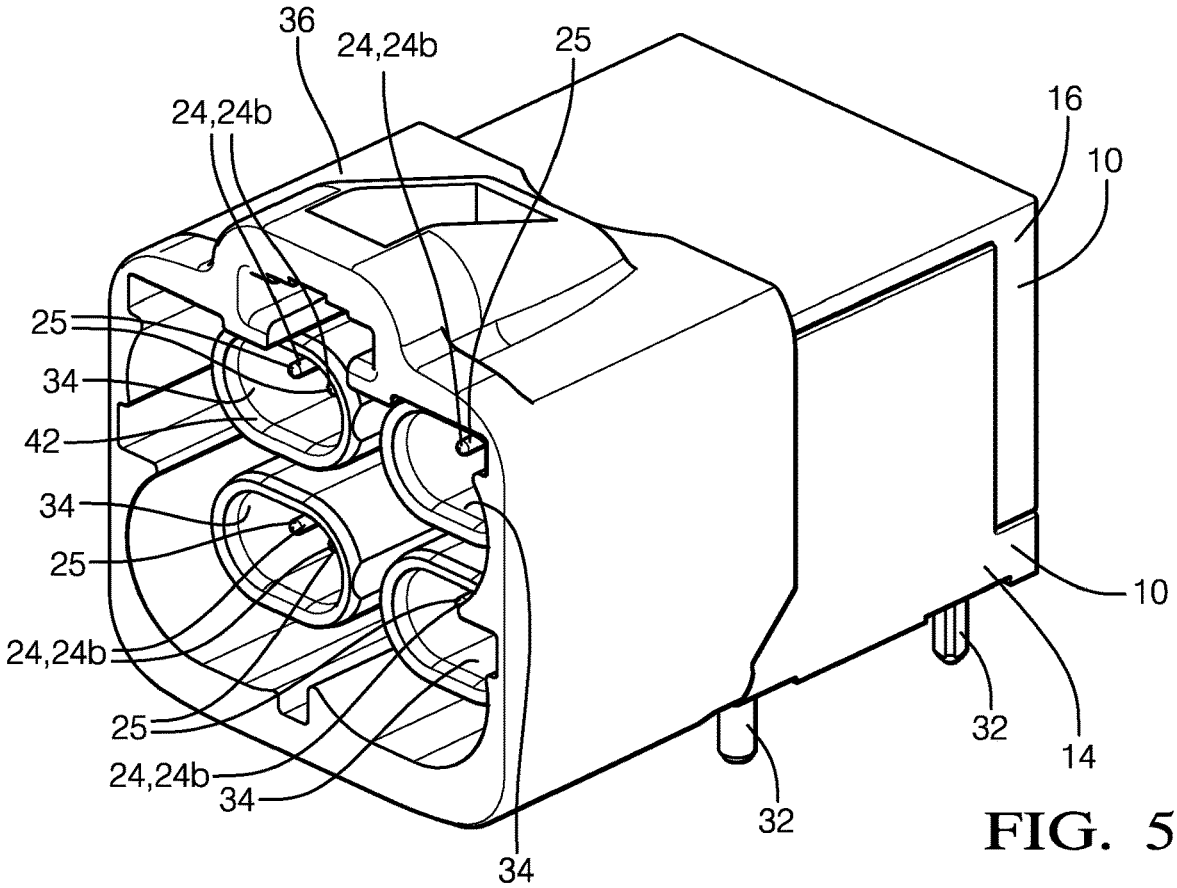
FIG. 5 shows a perspective view of an electrical connector according to a third design.

FIG. 4 shows an electrical connector according to a second design. The electrical connector according to the second design differs from the electrical connector described above in that it comprises two tunnels 12, as becomes apparent from two connection recesses 34 arranged next to each other side by side in a row like manner. It is to be understood that the electrical connector may also have more than two tunnels 12 arranged in a row. As in the first design, the connection recesses 34 of the second design may be integrally formed with the base part 14.

Figure 6:
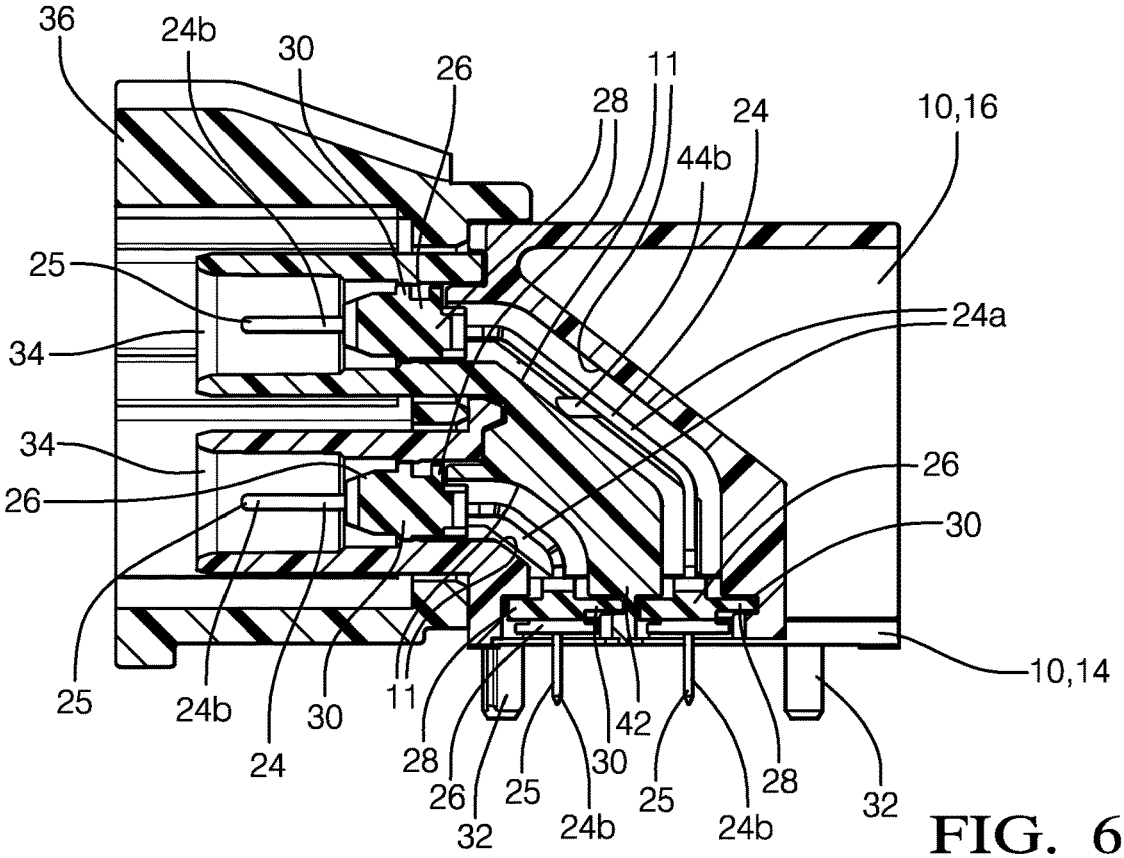
FIG. 6 shows a cross sectional view of the electrical connector of FIG. 5.
Figure 7A:
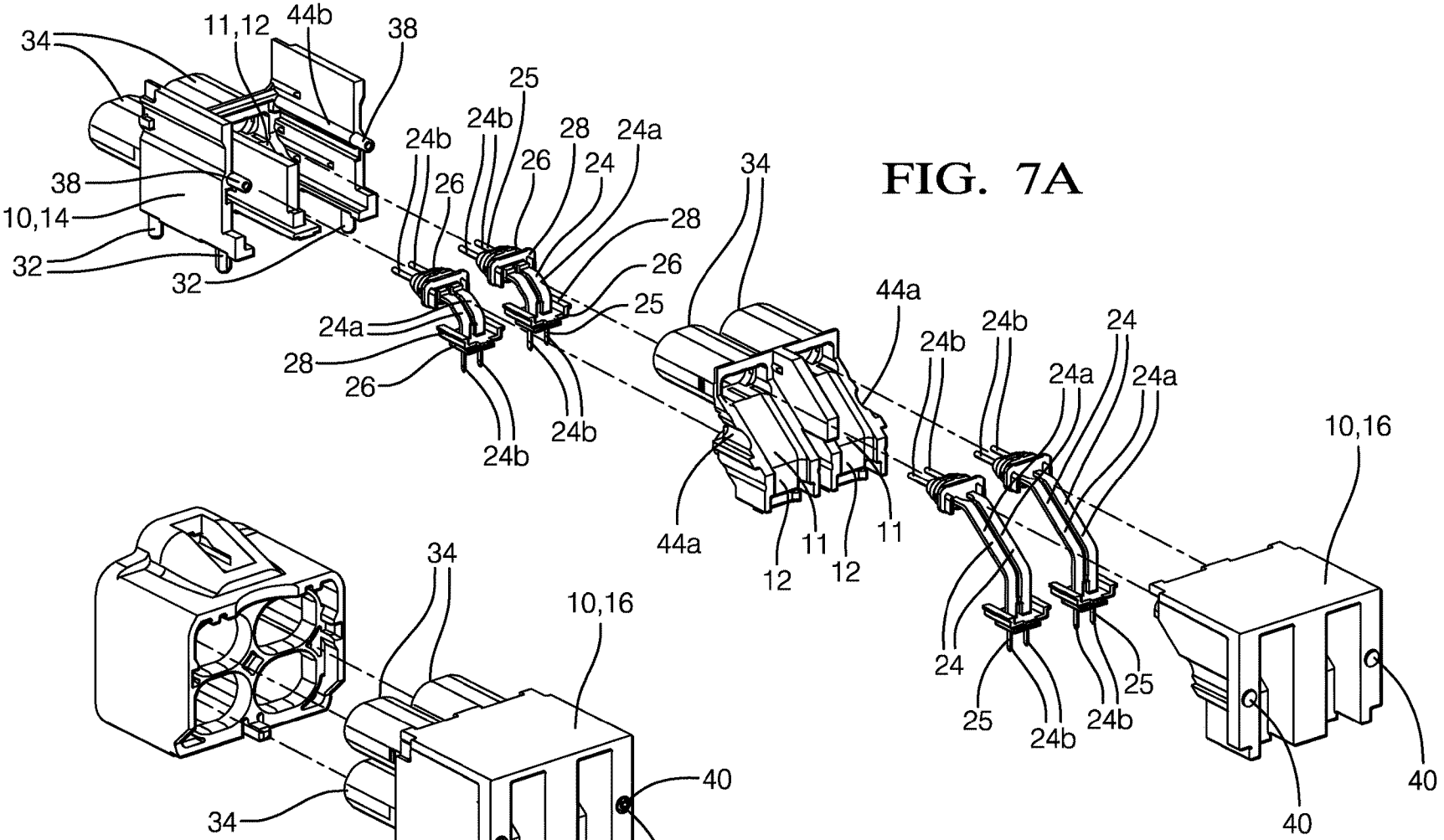
FIG. 7*a* shows a perspective view of the electrical connector of FIG. 5 in an initial step of assembly.
Figure 7B:
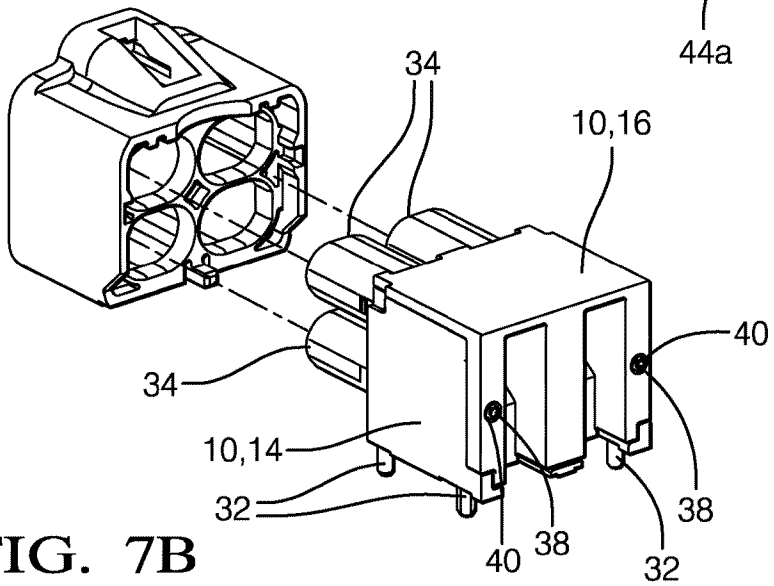
FIG. 7*b* shows a perspective view of the electrical connector of FIG. 5 in an advanced step of assembly.

An electrical connector according to a third design is shown in FIGS. 5 to 7*b*, wherein FIGS. 7*a* and 7*b* show two different steps during the assembly of the electrical connector according to the third design.

The electrical connector according to the third design differs from the electrical connector according to the first design in the number of tunnels 12. The electrical connector according to the third design comprises four tunnels 12, as becomes apparent from four connection recesses 34 shown in FIG. 5. As can be seen from FIG. 5, the connection recesses 34 and the tunnels 12, respectively, are arranged such that they form a two-rows/two-columns matrix. It is to be understood that an electrical connector may comprise different sorts of matrices, for example a three-rows/three-columns matrix, a two-rows/three-columns matrix or a three-rows/two-columns matrix. It is further to be understood that the number of rows and columns is not limited to two or three, i.e. other combinations are possible.

As can be seen best from FIG. 6, the electrical connector according to the third design comprises an intermediate part 42 arranged between the base part 14 and the cover part 16. The intermediate part 42 is connected to the base part 14 by means of guide structures 44*a* configured to engage with corresponding guide structures 44*b* formed on the base part 14 (FIG. 7*a*). Each of the guide structures 44*b* of the base part 14 extends in a longitudinal direction from the corresponding riveting mandrel 38 towards a connection recess 34 of the base part 14.

FIG. 6 shows, that the intermediate part 42 arranged between the base part 14 and the cover part 16 is configured to form at least one tunnel 12 between the base part 14 and the intermediate part 42 on one side of the intermediate part 42 and to form at least one tunnel 12 between the cover part 16 and the intermediate part 42 on the opposite side of the intermediate part 44.

As can be further seen from FIG. 6 and FIG. 7*a*, the base part 14 and the intermediate part 42 each form two connection recesses 34, wherein the connection recesses 34 of the intermediate part 42 function in a manner similar to the connection recess 34 of the base part 14. Alternatively, all of the connection recesses 34 may be integrally formed with the base part 14.

It is to be understood that an electrical connector may comprise more than one intermediate part 42 if the electrical connector has more than two rows of tunnels 12. Again, the base part 14 and the various intermediate parts 42 may form a row of connection recesses 34 each, or all of the connection recesses 34 may be integrally formed with the base part 14.

Finally, it is to be mentioned that the base part 14 and/or the cover part 16 of the electrical connector according to the first, second and third designs may consist of more than one piece. In particular, the base part 14 and/or the cover part 16 each may comprise at least two sub-parts which are connected to each other along the length of the tunnel 12, to form the respective base part 14 and/or cover part 16. Furthermore, the housing 10 may be formed by at least two parts that are connected to each other in a direction traverse to the length of the tunnel 12, wherein each part of the housing 10 defines one portion of at least one tunnel 12.

Furthermore, the intermediate part 44 may also be made of at least two sub-parts connected together to form the intermediate part 44.

The invention claimed is:

1. Electrical connector for high frequency data signal transmission comprising a housing comprising a base part and a cover part, at least one tunnel extending through the housing and at least one electrical lead extending through the at least one tunnel, wherein, in the at least one tunnel, at least a portion of the electrical lead is embedded in a surrounding material having a relative permittivity which is less than 2, at least one supporting element inserted into the tunnel and supporting the at least one electrical lead at a distance from a tunnel wall facing the at least one electrical lead, the supporting element having a perimeter and opposing ends, the electrical lead extends through the opposing ends, and the base part abuts one of the opposing ends and circumscribes the perimeter, and the cover part abuts the other of the opposing ends to capture the supporting element within the housing.

2. Electrical connector according to claim 1, wherein the relative permittivity of the surrounding material is less than 1.5.

3. Electrical connector according to claim 1, wherein the relative permittivity of the surrounding material is less than 1.1.

4. Electrical connector according to claim 1, wherein the relative permittivity of the surrounding material is at least approximately 1.

5. Electrical connector according to claim 1, wherein the relative permittivity of the surrounding material equals 1.

6. Electrical connector according to claim 1, wherein the surrounding material is a fluid.

7. Electrical connector according to claim 1, wherein the surrounding material is a gas.

8. Electrical connector according to claim 1, wherein at least an inner surface of a tunnel wall facing the at least one electrical lead is electrically conductive.

9. Electrical connector according to claim 8, wherein the housing is made of a conductive material.

10. Electrical connector according to claim 1, wherein a material of the supporting element is an insulating solid state material, comprising at least one of an insulating plastic material and a liquid crystal polymer; and wherein the relative permittivity of the surrounding material is less than a relative permittivity of the material of the supporting element.

11. Electrical connector according to claim 1, wherein the at least one supporting element comprises two supporting elements that close-off the tunnel at opposite ends and the at least one electrical lead extends through each of the two supporting elements.

12. Electrical connector according to claim 1, wherein a portion of the electrical lead surrounded by the surrounding material has a larger cross-sectional area than a portion of the electrical lead surrounded by the supporting element.

13. Electrical connector according to claim 1, wherein at least a portion of the electrical lead is a flat strip and comprises at least one round edge.

14. Method of manufacturing an electrical connector according to claim 1, the method comprising the steps of:

providing the housing, with the base part defining a first portion of the at least one tunnel extending through the housing and the cover part defining a second portion of the at least one tunnel, forming the supporting element to provide a first supporting element at a first portion of the at least one electrical lead and forming a second supporting element at a second portion of the at least one electrical lead by over-molding the first and second portions of the at least one electrical lead with a material forming the first and second supporting elements, wherein the first and second sections are separated from each other in a longitudinal direction of the at least one electrical lead, arranging the electrical lead with the first and second supporting elements in the first portion of the at least one tunnel defined by the base part, and attaching the cover part to the base part by means of riveting and/or welding.

15. Electrical connector according to claim 1, wherein the base part defines a first portion of the tunnel and the cover part defines a second portion of the tunnel such that the base part and the cover part together form the tunnel.

16. Electrical connector for high frequency data signal transmission comprising a housing, at least one tunnel extending through the housing and at least one electrical lead extending through the at least one tunnel, wherein, in the at least one tunnel, at least a portion of the electrical lead is embedded in a surrounding material having a relative permittivity which is less than 2, wherein the housing comprises a base part defining a first portion of the tunnel and a cover part defining a second portion of the tunnel such that the base part and the cover part together form the tunnel, and the cover part is riveted to the base part.

17. Electrical connector for high frequency data signal transmission comprising a housing, at least one tunnel extending through the housing and at least one electrical lead extending through the at least one tunnel, wherein, in the at least one tunnel, at least a portion of the electrical lead is embedded in a surrounding material having a relative permittivity which is less than 2, wherein the housing comprises a base part defining a first portion of the tunnel and a cover part defining a second portion of the tunnel such that the base part and the cover part together form the tunnel, wherein the cover part comprises an inner ridge forming a portion of a wall of the tunnel and the base part comprises an outer ridge which is arranged adjacent to the inner ridge such that the inner ridge and the outer ridge define a gap between the inner ridge and the outer ridge, and the gap is filled with a solder material.

18. Electrical connector for high frequency data signal transmission comprising a housing, at least one tunnel extending through the housing and at least one electrical lead extending through the at least one tunnel, wherein, in the at least one tunnel, at least a portion of the electrical lead is embedded in a surrounding material having a relative permittivity which is less than 2, wherein the housing comprises a base part defining a first portion of the tunnel and a cover part defining a second portion of the tunnel such that the base part and the cover part together form the tunnel, wherein the housing comprises at least one intermediate part arranged between the base part and the cover part and the tunnel comprises at least a first tunnel defined by the base part and the intermediate part and at least a second tunnel is defined by the cover part and the intermediate part.

* * * * *